US009657978B2

(12) United States Patent
Kopko et al.

(10) Patent No.: US 9,657,978 B2
(45) Date of Patent: May 23, 2017

(54) REFRIGERANT CONTROL SYSTEM FOR A FLASH TANK

(75) Inventors: William L. Kopko, Jacobus, PA (US); Israel Federman, York, PA (US); Satheesh Kulankara, York, PA (US); Andrew John Graybill, Etters, PA (US)

(73) Assignee: Johnson Controls Technology Company, Holland, MI (US)

( * ) Notice: Subject to any disclaimer, the term of this patent is extended or adjusted under 35 U.S.C. 154(b) by 1573 days.

(21) Appl. No.: 12/846,959

(22) Filed: Jul. 30, 2010

(65) Prior Publication Data

US 2011/0023515 A1 Feb. 3, 2011

Related U.S. Application Data

(60) Provisional application No. 61/230,393, filed on Jul. 31, 2009.

(51) Int. Cl.
*F25B 39/04* (2006.01)
*F25B 49/02* (2006.01)
(Continued)

(52) U.S. Cl.
CPC ..... *F25B 49/02* (2013.01); *F25B 1/10* (2013.01); *F25B 39/04* (2013.01); *F25B 41/04* (2013.01); *F25B 43/02* (2013.01); *F25B 49/022* (2013.01); *F28D 21/0017* (2013.01); *F28F 1/022* (2013.01); *F25B 1/047* (2013.01); *F25B 2339/021* (2013.01); *F25B 2339/024* (2013.01); *F25B 2341/0662* (2013.01);
(Continued)

(58) Field of Classification Search
CPC .. F25B 49/02; F25B 1/047; F25B 1/10; F25B 2341/0662; F25B 2400/13; F25B 2600/19; F25B 2600/2513; F25B 2700/195; F25B 2700/21163
USPC ..... 62/222, 224, 509
See application file for complete search history.

(56) References Cited

U.S. PATENT DOCUMENTS 5,079,929 A * 1/1992 Alsenz ..... 62/117
5,115,644 A 5/1992 Alsenz
(Continued)

FOREIGN PATENT DOCUMENTS

EP 1379817 10/2002
EP 1391664 2/2004
(Continued)

OTHER PUBLICATIONS

Chinese Office Action and Search Report for CN Application No. 201080033935.X mailed Dec. 22, 2014, 8 pages.

*Primary Examiner* — Elizabeth Martin
(74) *Attorney, Agent, or Firm* — Fletcher Yoder, P.C.

(57) ABSTRACT

A refrigeration system is provided, such as for use with chillers. The system uses a tube-side condenser, such as a microchannel condenser, along with a shell-side evaporator such as a falling film evaporator. A flash tank economizer is disposed between the condenser and the evaporator, and an inlet valve to the flash tank is controlled based upon sub-cooling of condensate from the condenser. The vapor exiting the flash tank may be fed via an economizer line to a system compressor. Liquid phase refrigerant combined with some gas phase refrigerant exits the flash tank and is directed through an orifice before entering the evaporator.

26 Claims, 3 Drawing Sheets

(51) Int. Cl.

| | |
|---|---|
| ***F25B 1/10*** | (2006.01) |
| ***F25B 41/04*** | (2006.01) |
| ***F25B 43/02*** | (2006.01) |
| ***F28D 21/00*** | (2006.01) |
| ***F28F 1/02*** | (2006.01) |
| *F25B 1/047* | (2006.01) |

(52) U.S. Cl.
CPC ..... *F25B 2400/13* (2013.01); *F25B 2400/23* (2013.01); *F25B 2600/19* (2013.01); *F25B 2600/2509* (2013.01); *F25B 2600/2513* (2013.01); *F25B 2700/195* (2013.01); *F25B 2700/21163* (2013.01); *F28F 2260/02* (2013.01)

(56) References Cited

U.S. PATENT DOCUMENTS

| | | | | |
|---|---|---|---|---|
| 5,632,154 | A * | 5/1997 | Sibik et al. | 62/99 |
| 6,293,114 | B1 * | 9/2001 | Kamemoto | 62/129 |
| 6,857,287 | B1 * | 2/2005 | Alsenz | 62/509 |
| 6,941,769 | B1 * | 9/2005 | Hill et al. | 62/512 |
| 7,353,659 | B2 * | 4/2008 | Crane et al. | 62/196.4 |
| 7,677,057 | B2 | 3/2010 | Yanik et al. | |
| 7,757,753 | B2 | 7/2010 | Yanik et al. | |
| 8,234,881 | B2 | 8/2012 | Yanik et al. | |
| 2004/0068999 | A1 * | 4/2004 | Jessen | 62/222 |
| 2006/0080998 | A1 * | 4/2006 | De Larminat et al. | 62/515 |
| 2008/0148760 | A1 * | 6/2008 | Yanik et al. | 62/324.1 |

FOREIGN PATENT DOCUMENTS

| | | |
|---|---|---|
| EP | 1491608 | 12/2004 |
| JP | 01134170 | 5/1989 |
| JP | 10318613 | 4/1998 |
| WO | 2008045039 | 4/2008 |
| WO | 2008045040 | 4/2008 |
| WO | 2009086493 | 7/2009 |

* cited by examiner

REFRIGERANT CONTROL SYSTEM FOR A FLASH TANK

CROSS REFERENCE TO RELATED APPLICATIONS

This application claims priority from and the benefit of U.S. Provisional Application Ser. No. 61/230,393, entitled "REFRIGERANT CONTROL SYSTEM AND METHOD", filed Jul. 31, 2009, which is hereby incorporated by reference.

BACKGROUND

The present invention relates generally to refrigeration systems using economizers, such as those employed for chiller applications.

Some refrigeration and air conditioning systems rely on chillers to reduce the temperature of a process fluid, typically water. In such applications, the chilled water may be passed through downstream equipment, such as air handlers, to cool other fluids, such as air in a building. In typical chillers, the process fluid is cooled by an evaporator that absorbs heat from the process fluid by evaporating refrigerant. The refrigerant is then compressed by a compressor and transferred to a condenser. In the condenser, the refrigerant is cooled, typically by air flow and recondenses into a liquid. Air cooled condensers typically comprise a condenser coil and a fan that induces airflow over the coil. In some conventional designs, economizers are utilized in the chiller design to improve performance. In systems that employ flash tank economizers, the condensed refrigerant may then be directed to the flash tank where the liquid refrigerant at least partially evaporates. The vapor may be extracted from the flash tank and redirected to the compressor, while liquid refrigerant from the flash tank is directed to the evaporator, closing the refrigeration loop.

In a conventional system of this type, a flow control valve, which may be referred to as a feed valve, is provided in the conduit between the condenser and the flash tank. Flow into the flash tank is typically controlled in a closed-loop manner based upon the flash tank level. A drain valve, used to extract liquid from the flash tank also may be controlled in a closed-loop manner, typically based upon superheating of the refrigerant leaving the evaporator. Superheating of the refrigerant refers to heating above the boiling point.

However, applications exist for other types of evaporators that are generally incapable of superheating the refrigerant. Certain advantages may flow from the use of such evaporators in conjunction with flash tanks. Evaporators of this type may include shell-side evaporators, such as falling film evaporators, in which the refrigerant is sprayed over tubes through which the second process fluid (e.g., water) circulates. Other evaporators with shell-side evaporation include flooded evaporators or hybrids of falling film and flooded evaporator designs. The evaporation of the refrigerant on the outside of the tubes cools the second process fluid. Because no superheating occurs in the refrigerant outflow from the evaporator, conventional techniques for regulating levels in a flash tank based upon superheating are not available.

There is a need, therefore, for improved techniques for controlling refrigerant levels and flow in heating, ventilating, and air conditioning systems that can make use of tube-side condensers and shell-side evaporators with flash tanks.

SUMMARY

The present invention provides a system design and control methodology designed to respond to such needs. In particular, the system may be used with any desired type of refrigeration system, but is particularly well-suited to applications for chilling of a fluid, such as water. The system makes use of a tube-side condenser and a shell-side evaporator, such as a falling film evaporator. The system also makes use of a flash tank between the condenser and evaporator. Condenser outflow subcooling may be used to regulate the inflow to the flash tank. Outflow from the flash tank to the evaporator may then be controlled by an orifice, which in certain embodiments, may be a fixed orifice. The orifice is sized, and the conduit for outflow from the flash tank is placed so as to provide some gas in the outflow from the flash tank, which would typically include primarily liquid from a mass flow standpoint. The invention also provides for multi-parameter control of the feed tank feed line, such as based on compressor capacity in addition to condenser output subcooling. Some of the parameters may effectively provide a feed forward component, as in the case of compressor capacity.

DRAWINGS

DETAILED DESCRIPTION

Figure 1:
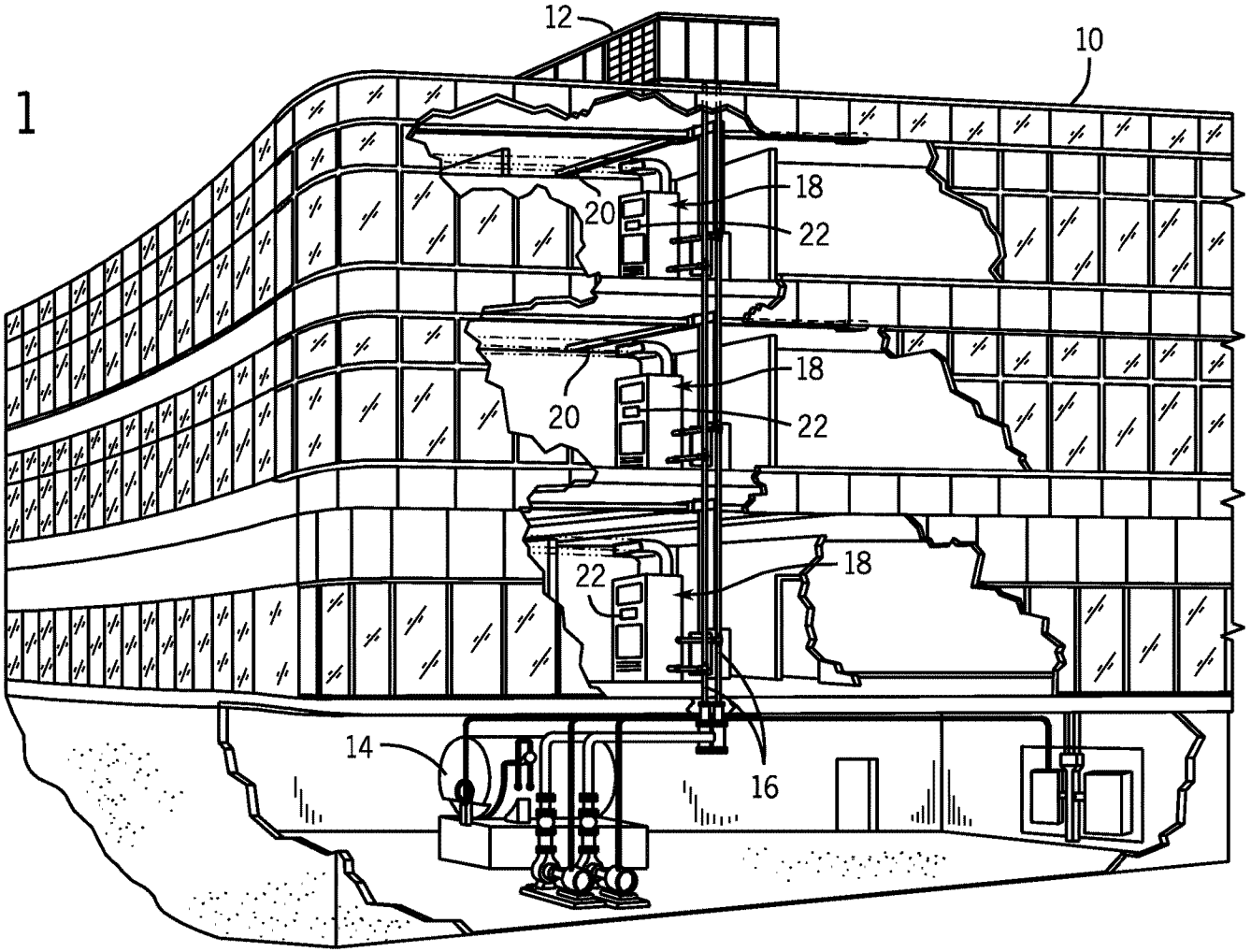
FIG. 1 is an illustration of an exemplary embodiment of a commercial heating ventilating, air conditioning and refrigeration (HVAC&R) system that includes an air cooled refrigeration system in accordance with aspects of the present techniques.

FIG. 1 depicts an exemplary application for a refrigeration system. Such systems, in general, may be applied in a range of settings, both within the HVAC&R field and outside of that field. The refrigeration systems may provide cooling to data centers, electrical devices, freezers, coolers, or other environments through vapor-compression refrigeration, absorption refrigeration, or thermoelectric cooling. In presently contemplated applications, however, refrigeration systems may be used in residential, commercial, light industrial, industrial, and in any other application for heating or cooling a volume or enclosure, such as a residence, building, structure, and so forth. Moreover, the refrigeration systems may be used in industrial applications, where appropriate, for basic refrigeration and heating of various fluids.

FIG. 1 illustrates an exemplary application, in this case an HVAC&R system for building environmental management that may employ heat exchangers. A building 10 is cooled by a system that includes a chiller 12 and a boiler 14. As shown, chiller 12 is disposed on the roof of building 10 and boiler 14 is located in the basement; however, the chiller and boiler may be located in other equipment rooms or areas next to the building. Chiller 12 is an air cooled or water cooled device that implements a refrigeration cycle to cool water. Chiller 12 is housed within a single structure that includes a refrigeration circuit, a free cooling system, and associated equipment such as pumps, valves, and piping. For example, chiller 12 may be single package rooftop unit that incorporates a free cooling system. Boiler 14 is a closed vessel in which water is heated. The water from chiller 12 and boiler 14 is circulated through building 10 by water conduits 16. Water conduits 16 are routed to air handlers 18, located on individual floors and within sections of building 10.

Air handlers 18 are coupled to ductwork 20 that is adapted to distribute air between the air handlers and may receive air from an outside intake (not shown). Air handlers 18 include heat exchangers that circulate cold water from chiller 12 and hot water from boiler 14 to provide heated or cooled air. Fans, within air handlers 18, draw air through the heat exchangers and direct the conditioned air to environments within building 10, such as rooms, apartments, or offices, to maintain the environments at a designated temperature. A control device, shown here as including a thermostat 22, may be used to designate the temperature of the conditioned air. Control device 22 also may be used to control the flow of air through and from air handlers 18. Other devices may, of course, be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building.

Figure 2:
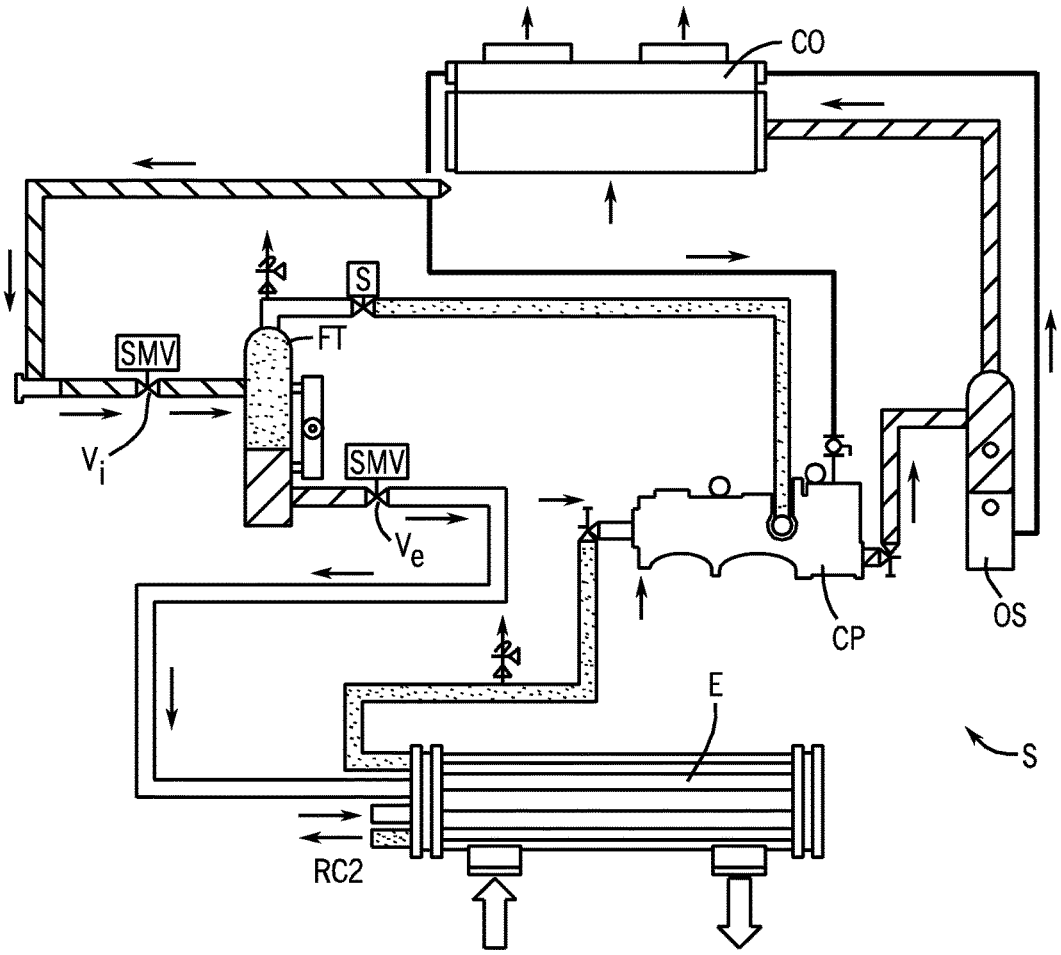
FIG. 2 PRIOR ART
FIG. 2 is a diagrammatical representation of a prior art refrigeration system for use in a chiller application such as that shown in FIG. 1, and that employs evaporator discharge superheating for closed loop control of a flash tank drain valve.

FIG. 2 is a diagrammatical illustration of a prior art system that could be used in certain applications. The system shown in FIG. 2 could be used, for example, with economized screw chillers. The system employs a flash tank economizer FT and a direct-expansion (DX) evaporator E. As will be appreciated by those skilled in the art, liquid refrigerant exiting the condenser CO flows to a flash tank FT through an inlet or feed valve $V_i$. From the flask tank FT, vapor flows to a compressor CP, while liquid refrigerant flows to an evaporator E through a flash tank exit valve $V_e$. The liquid refrigerant is evaporated in the evaporator, and the vaporized refrigerant again flows to the compressor CP. From the compressor, the refrigerant flows through an oil separator OS and from there returns to the condenser CO.

The system illustrated in FIG. 2 utilizes two electronic expansion valves and a flash tank level sensor to control refrigerant in the system. One electronic expansion valve controls refrigerant fed into the flash tank, while the other controls a refrigerant liquid exiting the flash tank. These valves, labeled $V_i$ and $V_e$ in FIG. 2, may be controlled in a closed-loop manner. In particular, the flash tank level sensor provided in the flash tank is used to control opening and closing of the feed valve $V_i$. The vapor exiting the evaporator in this embodiment of the prior art is at least partially superheated. Thus, the flash tank drain valve $V_e$ is controlled in a closed loop manner based upon superheating of the evaporator exit flow. In this arrangement, the feed valve $V_i$ is closed in response to a high liquid level in a flash tank.

As will be appreciated by those skilled in the art, problems with such arrangements can be manifold. For example, if a microchannel condenser is to be employed, as opposed to conventional tube and fin heat exchangers, a relatively small internal volume is available for the refrigerant within the condenser. Thus, small changes in the amount of refrigerant liquid in the condenser can result in substantial changes in condenser performance. In some cases, this can result in extra liquid in the condenser that can cause excessively high condenser pressures, sometimes resulting in the compressor overloading or nuisance tripping.

Other drawbacks of such systems include the fact that they require a level sensor in the flash tank and two electronic expansion valves. The level sensor in an associated stand tube can be expensive and may be unreliable. The electronic expansion valves, similarly, are expensive and potentially unreliable. In addition, potential issues may arise due to undesirable interactions between the controls of the two valves that can create unstable operation.

A further drawback of such systems is that they are generally unsuitable for use with flooded or falling film evaporators, or more generally with shell-side evaporators. That is, because such evaporators produce essentially zero superheat at normal operating conditions, superheat control of the flash tank discharge valve $V_e$ is unworkable. In general, such arrangements relying upon multiple sensors and expansion valves require high level of sophisticated controls, which can increase system cost and reduce reliability.

Figure 3:
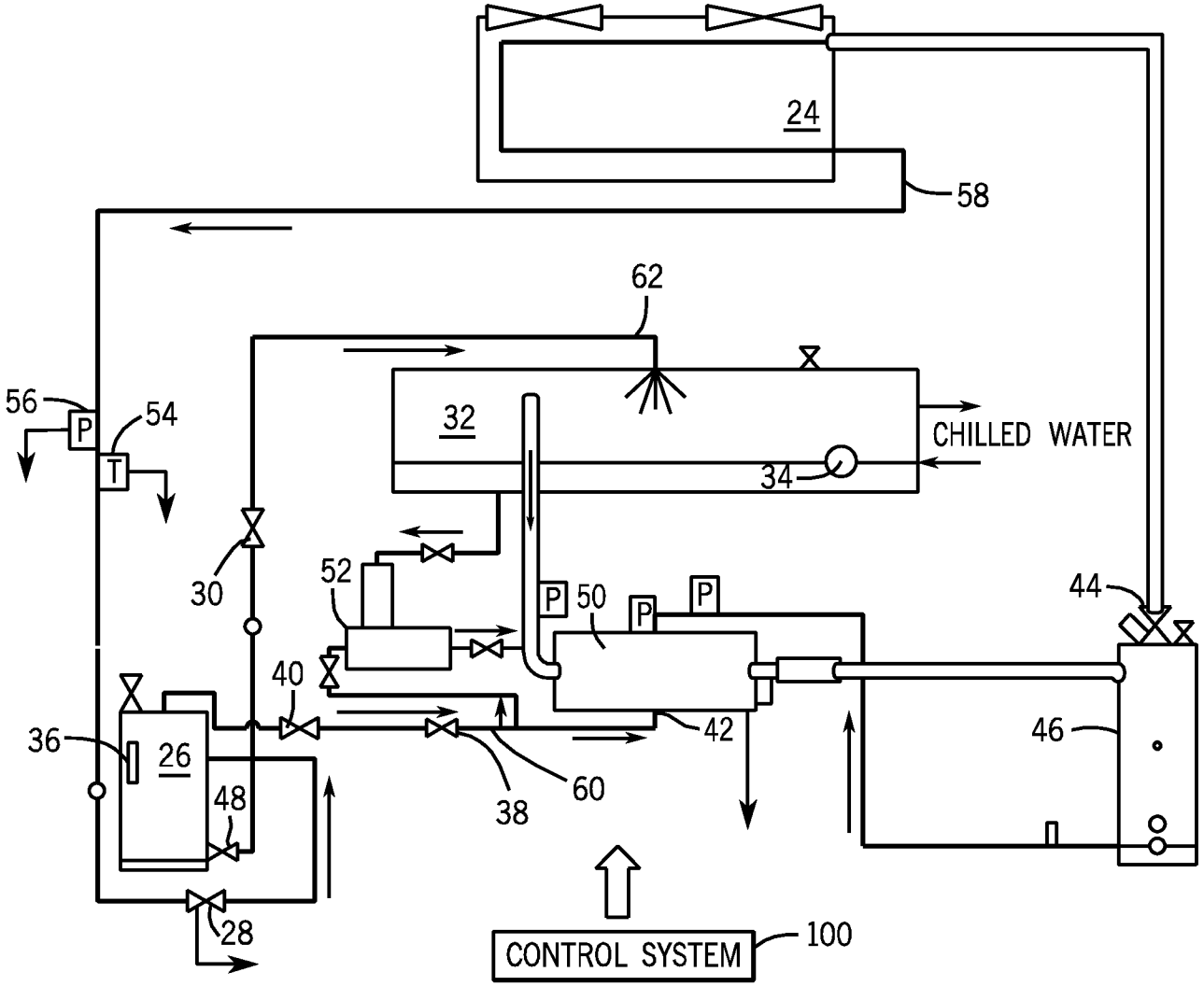
FIG. 3 is a diagrammatical representation of an exemplary HVAC&R system in accordance with the present techniques.

FIG. 3 illustrates an exemplary refrigeration system in accordance with aspects of the present technique that can be used in arrangements such as that shown in FIG. 1. FIG. 3 illustrates an exemplary piping configuration for the invention employed in an exemplary economized screw chiller controlled by a control system 100. In this arrangement, a condenser 24 is in fluid communication with a flash tank 26 by the intermediary of a flash tank feed valve 28, functioning as an expansion valve. A liquid-rich mixture of vapor and liquid refrigerant exits the flash tank through an orifice 30 to enter an evaporator 32. A site glass 34 is provided in the evaporator 32 to allow for visual verification of the level of refrigerant liquid or liquid-rich-to-phase mixture in the evaporator. Similarly, a level switch 36 in the flash tank 26 provides a signal to the control system 100 to prevent overfilling of the flash tank. The flash tank 26 will contain primarily vapor, with some liquid refrigerant collecting near the bottom of the tank. A shut-off valve 38 is provided in an exit line from the flash tank and can be used to interrupt any flow of vapor from the flash tank. Similarly, a remotely controllable solenoid valve 40 is provided in this line, which provides economizer flow of refrigerant vapor to the compressor economizer port as indicated by reference numeral 42. Similarly, a shut-off valve 44 is provided upstream of the condenser 24 to interrupt flow of refrigerant to the condenser as needed. The illustrated embodiment of the shut-off valve 44 is provided in an outlet line from an oil separator 46 where oil is separated from the refrigerant or before returning the refrigerant to the condenser. Finally, another shut-off valve 48 is provided in the mixed phase flow line exiting the flash tank 26.

As will appreciated by those skilled in the art, the evaporator 32, which is a shell side evaporator, and in a presently contemplated embodiment is a falling film evaporator, produces vapor that is substantially un-superheated, and this vapor flows to the system compressor 50. The compressor may also receive economizer flow of vapor from the flash tank 26. Similarly, oil return to the compressor may be provided by an eductor 52 so as to return liquid refrigerant and oil from the evaporator 32.

In the illustrated embodiment a temperature sensor 54 and a pressure transducer 56 are provided in the liquid refrigerant flow line 58 that completes the circuit from the condenser 24 to the flash tank 26. As summarized below, these sensed parameters are used by a system controller 100 to calculate subcooling of the liquid exiting the condenser. The condenser is preferably microchannel design, although conventional round-tube coils also may be used. The piping further includes the economizer line indicated by reference numeral 60 in FIG. 3 to deliver vapor flow from the flash tank 26 to the compressor 50, and conduit 62 which delivers mixed-phase flow from the flash tank 26 to the evaporator 32.

As will be appreciated by those skilled in the art, microchannel heat exchangers of the type discussed herein may offer significant advantages over conventional tube and fin heat exchangers. They typically include an inlet header or manifold, and an outlet header or manifold, between which a series of microchannel tubes are disposed to allow for flow of liquid and/or vapor phase refrigerant. The refrigerant undergoes heating or cooling, depending upon the relative temperatures, and may change phase, be subcooled, or be superheated in the tubes. In the case of condenser 24, the vapor phase refrigerant will be condensed and subcooled. Exemplary construction of such heat exchangers is described in U.S. patent application Ser. No. 12/040,612, entitled "MULTICHANNEL HEAT EXCHANGER WITH DISSIMILAR MULTICHANNEL TUBES," to Yanik et al., filed on Feb. 29, 2008; U.S. patent application Ser. No. 12/040,661, entitled "MULTICHANNEL HEAT EXCHANGER WITH DISSIMILAR TUBE SPACING," to Yanik et al., filed on the same date; and U.S. patent application Ser. No. 12/200,471, entitled "MULTICHANNEL HEAT EXCHANGER WITH DISSIMILAR FLOW," to Yanik et al., filed on Aug. 28, 2008, all of which are incorporated into the present disclosure by reference.

Control system 100 may include multiple components for sensing data, transforming data, storing data, storing control routines, so forth. The control system 100 also may include components for operator interaction with the system, such as for checking operating parameters, inputting set points and desired operating parameters, checking error logs and historical operations, and so forth. The control system may include, for example, analog and/or digital control circuitry, such as microprocessors, microcontrollers, programmed general purpose and special purpose computers, and so forth. The control system also includes any needed memory circuitry for storing programs and control routines and algorithms implemented for control of the various system components, such as the feed valve between the condenser and the flash tank. The control system will also typically control, for example, valving for the economizer line, speed and loading of the compressor, and so forth, and the memory circuitry may store set points, actual values, historic values and so forth for any or all such parameters. As summarized below, the control system 100 will collect data, such as temperature and pressure data in the liquid refrigerant line 58 between the condenser and the flash tank, and control system operating conditions, such as by regulation of opening and closing of valve 28, which provides refrigerant to the flash tank 26. The control system also may operate on the basis of other parameters, such as compressor capacity, which may be determined, for example, by monitoring and controlling the speed of the compressor. Further parameters that may be used as inputs for control by the control system may include ambient air temperature, condensing pressure, economizer operation (i.e., whether the economizer is operating and at what rate), evaporating pressure, and fan operation (i.e., whether one or more fans associated with the condenser 24 is operating and at what condition or speed).

In operation, the system described above allows for optimization of chiller performance while reducing costs. The flash tank flow valve 28 is controlled to maintain an approximately constant amount of subcooling from the condenser based upon analysis of the pressures and temperatures detected in the condensate line. For a microchannel condenser coil, the quantity of refrigerant that may be stored in the microchannel condenser is relatively small, and subcooling control ensures good operation over a wide range of operating conditions. The closed-loop control algorithm employed for this purpose may be based upon a system model, with determinations of on and off positions of valve 28 being made in a binary manner, or preferably the valve may be modulated to open between maximum and minimum flow limits. Alternatively, the control may be based upon predetermined set points, such as by use of a look-up table in which valve settings are determined based upon various subcooling amounts. Similarly, multidimensional algorithms and lookup tables may be employed, in which a plurality of parameters, including condensate subcooling, are used to determine the appropriate position of valve 28. Based upon such algorithms, the control system outputs appropriate control signals to the valve (e.g., to one or more electrical operators that control the valve position) to implement the desired control of condensate flow to the flash tank.

Moreover, the use of an orifice, particularly a fixed orifice 30 for a flow from the flash tank to the evaporator, rather than an electronic expansion valve, reduces costs of the system and improves performance as compared to prior art systems of the type illustrated in FIG. 2. It is presently contemplated that the exit line from the flash tank that draws the liquid refrigerant from the flash tank will be situated relatively low in the flash tank and will draw both liquid and gaseous refrigerant. According to certain embodiments, the line may contain primarily liquid phase refrigerant, as measured by mass. While a majority of the mass flow through the line may be liquid phase, it is contemplated that the flow will include gas phase refrigerant which, it is believed, provides a better spray in the evaporator 32, offering improved wetting of tubes (when a falling film evaporator is used) and thereby improved evaporator performance. The orifice is sized to maintain the flash tank essentially empty of liquid during normal operating conditions. The small amount of flash gas that exits the flash tank with the liquid through this orifice assures stable operation.

It is believed that the optimum chiller performance occurs with two-phase flow exiting the flash tank. This result may be found surprising because vapor flowing from the flash tank to the evaporator would normally be believed to result in a penalty in theoretical cycle capacity and efficiency. Actual testing appears to show that a small amount of gas mixed with the liquid flow from the flash tank improves evaporator performance and overall chiller efficiency and capacity. In contrast, prior art systems effectively guarantee that all liquid exits the expansion tank, providing less than optimum chiller performance.

It should also be noted that an added advantage of the use of an orifice in the conduit between a flash tank and the evaporator effectively reduces the refrigerant charge. That is, emptying a flash tank of liquid removes a substantial amount of refrigerant from the system, which may be on the order of 10-20 percent of the total refrigerant charge. As will be appreciated by those skilled in the art, the reduction in total refrigerant charged reduces the investment in refrigerant in the system, reducing overall costs.

Regarding control by the control system 100, a presently contemplated embodiment employs a proportional plus integral (PI) control based on condenser subcooling as discussed above. Those skilled in the art will recognize that subcooling in this context is the difference between the saturation temperature and the measured refrigerant liquid temperature exiting the condenser. If the measured subcooling is above the set-point provided to the control system 100, valve 28 is opened to drain more liquid refrigerant from the condenser. Likewise, if the subcooling is below the set-point, the valve is closed to backup more liquid refrigerant in the condenser.

An added advantageous feature of the system is the use of compressor speed to allow the valve to respond quickly to changing conditions. In particular, compressor speed or compressor capacity, or another parameter representative of these operating conditions, effectively provides a feed forward component that allows for opening the valve in advance based upon an increase in compressor speed or capacity. Increasing compressor speed will normally increase the refrigerant mass flow rate through the system. Thus, if the valve remains in the same position, the subcooling would increase, but a time lag would be seen in the response of the system temperatures and pressures. Likewise, the control system may close the valve in response to a decrease in the compressor speed. This use of compressor speed, or a parameter representative of compressor capacity, as a feed-forward control component allows for valve control to anticipate subcooling changes and mass flow rate changes and to provide improved control. Additional optional features of the control scheme may include proportional, integral, and differential (PID) control rather than PI control. Other variations may include control further based on ambient temperature compensations, discharge pressure adjustments, and so forth.

In a presently contemplated embodiment, it has been found that a fixed set point for subcooling of approximately 5 to 10° F. provides good performance and stable operation over a wide range of conditions. However, it may be possible to further increase chiller efficiency or capacity by optimizing subcooling for individual operating conditions. For example, it may be desirable to increase the amount of subcooling at part-load conditions when the economizer is off. In high ambient conditions, it may be desirable to decrease subcooling to reduce the condensing temperature. As noted above, possible inputs for control of the flash tank via the valve 28 might include ambient air temperature, condensing pressure, compressor speed, economizer operation, evaporating pressure, and fan operation. Adjustments in subcooling set point would normally be quite gradual to prevent undesirable interaction with the subcooling control described above.

The system described above also has improved refrigerant storage capacity for refrigerant during servicing or shipping. For example, to store refrigerant, valves 38 and 48 may be closed and compressor 50 may be operated. The compressor will then pump refrigerant vapor from the evaporator to the condenser, which condenses the refrigerant to liquid. The liquid would accumulate in the flash tank and condenser. Once refrigerant is pumped out of the evaporator, the compressor 50 would be stopped and the discharge shut-off valve 44 would be closed to prevent back flow of vapor from the condenser. This approach allows the use of the full volume of the flash tank and associated piping for refrigerant storage in addition to the condenser.

There are many other configurations that may employ certain of the novel features described above. For example, if economized operation is not required, the flash tank 26, orifice 30, and related economizer lines may be eliminated. The valve 28 can feed the evaporator directly. The eductor 52 would use compressor discharge gas as the driving fluid, or it can continue to be connected to the economizer port on the compressor. Control of the valve 28 can remain essentially the same. As another example, the flash tank economizer could be replaced by a heat exchanger acting as an economizer. In this case, a portion of the refrigerant condensed in the condenser flows through one side and the rest flows through the second side of the heat exchanger economizer. The portion that flows through the first side evaporates cooling the refrigerant flow on the second side. The evaporated refrigerant on the first side flows through the economizer lines to a system compressor. The refrigerant on the second side, after cooling in the heat exchanger economizer, flows through valve 28 to the evaporator. Control of valve 28 will remain essentially the same.

The use of compressor speed or other compressor capacity control signal as a variable to control expansion valve position is a novel feature that has many other applications. The feature is based upon opening the expansion valve in response to increases in compressor speed and closing the valve in response to decreases in compressor speed. This feature can improve control of conventional electronic expansion valves that control suction superheat in addition to valves with that control condenser subcooling.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or resequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilating, air conditioning or refrigeration system comprising:

a condenser configured to condense refrigerant vapor into a condensate;

a flash tank configured to receive the refrigerant as the condensate from the condenser and to at least partially vaporize the refrigerant;

an evaporator configured to receive refrigerant from the flash tank and to vaporize the refrigerant;

a compressor configured to receive condensate vapor from the evaporator and to compress the refrigerant vapor for return to the condenser;

an electronically controlled flash tank feed valve disposed between the condenser and the flash tank, configured to control a flow of condensate from the condenser to the flash tank;

sensors configured to sense pressure and temperature of the condensate as the condensate flows from the condenser; and a control system coupled to the flash tank feed valve and configured to regulate opening and closing of the flash tank feed valve to control the flow of condensate based upon subcooling of the condensate, the control system being coupled to the sensors and configured to receive signals from the sensors representative of pressure and temperature and to compute the subcooling of the condensate based upon the signals for control of the flash tank feed valve, wherein the control system is coupled to the compressor and is configured to receive a feed forward parameter from the compressor indicative of compressor capacity, and wherein the control system is configured to regulate opening and closing of the flash tank feed valve based upon the feed forward parameter, such that the control system anticipates changes in the subcooling of the condensate.

2. The system of claim 1, comprising an orifice disposed between the flash tank and the evaporator for regulating flow of condensate from the flash tank to the evaporator.

3. The system of claim 2, wherein the orifice is a fixed orifice.

4. The system of claim 2, wherein the orifice is a variable orifice.

5. The system of claim 1, wherein the system is configured to permit a flow stream of refrigerant from the flash tank to the evaporator, wherein the flow stream includes liquid and vapor phase refrigerant.

6. The system of claim 5, wherein the flow stream is primarily liquid phase refrigerant as measured by mass.

7. The system of claim 1, wherein the parameter is compressor speed.

8. The system of claim 1, wherein the evaporator is a shell-side evaporator.

9. The system of claim 8, wherein the evaporator is a falling film evaporator.

10. The system of claim 8, wherein the evaporator is a flooded evaporator.

11. The system of claim 8, wherein the evaporator is a hybrid of flooded and falling film type evaporators.

12. The system of claim 1, wherein the condenser is a microchannel tube condenser.

13. The system of claim 1, wherein the condenser is a tube and fin condenser.

14. A heating, ventilating, air conditioning or refrigeration system comprising:

a condenser configured to condense refrigerant vapor into a condensate;

a flash tank configured to receive the refrigerant as the condensate from the condenser and to at least partially vaporize the refrigerant;

a shell-side evaporator configured to receive the refrigerant from the flash tank and to vaporize the refrigerant;

a compressor configured to receive condensate vapor from the evaporator and to compress the refrigerant vapor for return to the condenser;

an electronically controlled flash tank feed valve disposed between the condenser and the flash tank, configured to control a flow of condensate from the condenser to the flash tank;

an orifice disposed between the flash tank and the evaporator, configured to regulate flow of refrigerant from the flash tank to the evaporator;

a pressure sensor configured to sense pressure of the condensate as it flows from the condenser and to produce a pressure signal representative thereof;

a temperature sensor configured to sense temperature of the condensate as it flows from the condenser and to produce a temperature signal representative thereof; and a control system coupled to the pressure and temperature sensors and configured to receive the pressure and temperature signals and to compute subcooling of the condensate, the control system also coupled to the flash tank feed valve and configured to regulate opening and closing of the feed valve to control the flow of condensate based upon subcooling of the condensate, wherein the control system is coupled to the compressor and is configured to receive a parameter from the compressor indicative of compressor capacity, and wherein the control system is configured to regulate opening and closing of the flash tank feed valve based upon the parameter, such that the control system anticipates changes in the subcooling of the condensate.

15. The system of claim 14, wherein the condenser is a microchannel tube condenser, and wherein the orifice is a fixed orifice.

16. The system of claim 14, wherein the condenser is a tube and fin condenser, and wherein the orifice is a fixed orifice.

17. The system of claim 14, wherein the condenser is a microchannel condenser, and wherein the orifice is a variable orifice.

18. The system of claim 14, wherein the condenser is a tube and fin condenser, and wherein the orifice is a variable orifice.

19. The system of claim 14, wherein the system is configured to permit a flow stream of refrigerant from the flash tank to the evaporator, wherein the flow stream includes liquid and vapor phase refrigerant.

20. The system of claim 19, wherein the flow stream is primarily liquid phase refrigerant as measured by mass.

21. The system of claim 14, wherein the parameter is compressor speed.

22. The system of claim 14, wherein the evaporator is a falling film evaporator.

23. The system of claim 14, wherein the evaporator is a flooded evaporator.

24. The system of claim 14, wherein the evaporator is a hybrid of flooded and falling film type evaporators.

25. A heating, ventilating, air conditioning or refrigeration system comprising:

a condenser configured to condense refrigerant vapor into a condensate;

an evaporator configured to receive refrigerant from the condenser and to vaporize the refrigerant;

a compressor configured to receive refrigerant vapor from the evaporator and to compress the refrigerant vapor for return to the condenser; and an expansion valve disposed between the condenser and the evaporator;

wherein operation of the expansion valve is controlled based upon condensate subcooling and based upon a parameter received from the compressor indicative of capacity, such that the heating, ventilating, air conditioning or refrigeration system anticipates changes in the condensate subcooling.

26. The system of claim 25, comprising a control system coupled to the expansion valve and configured to regulate opening and closing of the expansion valve based upon subcooling of the condensate, wherein the expansion valve is an electronic expansion valve and the condenser is a microchannel condenser.

* * * * *